US005404822A

United States Patent [19]

Jaskiewicz

[11] Patent Number: 5,404,822

[45] Date of Patent: Apr. 11, 1995

[54] GLASS SHELF AND BRACKET ASSEMBLY

[75] Inventor: Robert W. Jaskiewicz, Buford, Ga.

[73] Assignee: Tempglass Eastern, Inc., Buford, Ga.

[21] Appl. No.: 62,548

[22] Filed: May 7, 1993

[51] Int. Cl.[6] ..... A47B 9/00

[52] U.S. Cl. ..... 108/108; 248/250

[58] Field of Search ..... 108/42, 108, 110; 248/250, 247, 345.1, 608, 634, 635, 632

[56] References Cited

U.S. PATENT DOCUMENTS

| | | | |
|---|---|---|---|
| 3,432,134 | 3/1969 | Forschmidt . | |
| 4,010,697 | 3/1977 | Einhorn . | |
| 4,166,018 | 8/1979 | Chapin . | |
| 4,434,900 | 3/1984 | Cook . | |
| 4,538,784 | 9/1985 | O'Flanagan | 108/108 X |
| 4,709,892 | 12/1987 | Gurgui | 248/250 |
| 4,738,426 | 4/1988 | Bessinger | 248/250 |
| 4,863,127 | 9/1989 | Handler | 248/250 X |
| 4,901,965 | 2/1990 | Bowman | 108/108 X |
| 5,054,404 | 10/1991 | Melgers | 108/108 |
| 5,069,408 | 12/1991 | Bessinger | 108/108 X |
| 5,080,310 | 1/1992 | Choi . | |

OTHER PUBLICATIONS

CRL Company Catalog, p. 235, "The Glass Shelf Kit" from Knape & Vogt.

*Primary Examiner*—Jose V. Chen

*Attorney, Agent, or Firm*—Dinnin & Dunn

[57] ABSTRACT

A shelf and bracket assembly which includes a shelf, a first and second bracket, and a securing structure. The first and second brackets include a glass supporting member which is inserted within a rubber insert. The rubber insert is then itself placed within a metal casing which has a key lock orifice for use in fastening each of the brackets vertically on a wall or other suitable surface. The shelf is then placed upon the first and second brackets.

1 Claim, 2 Drawing Sheets

GLASS SHELF AND BRACKET ASSEMBLY

BACKGROUND OF THE INVENTION

1. Field of the Invention

The present invention relates generally to a shelf assembly and, more specifically, to a glass shelf and bracket assembly.

2. Description of the Related Art

Shelf brackets used in supporting shelves have been known for many years. When a shelf is mounted between a first and second bracket, the shelf in general must have a depth no greater than the length of the lower arms of the brackets, this will prevent the shelf from tipping over. Some brackets have employed flanges or clips for holding the shelves, which allows for deeper shelves to be used.

Cantilever type shelf brackets, where a panel is inserted into the throat of the brackets for support, have been used with wood, particle board, glass and marble panels. The cantilever type shelf bracket is illustrated in U.S. Pat. No. 4,738,426. The cantilever shelf bracket is capable of receiving a glass or marble shelf panel without scratching, marring or applying localized stress to the panel during assembly. The bracket has a laterally oriented throat and a U-shaped resilient interface strip fitted over the rear edge and rear portion of the shelf panel. The resilient interface strip is then received within the shelf bracket throat. The interface strip is locked into place within the throat. The strip also protects the glass from abrasion and marring.

Another shelf bracket assembly is illustrated in U.S. Pat. No. 4,010,697. The bracket assembly includes a plate and a pair of flanges which define three orthogonal mounting surfaces. The bracket may be mounted in any desired position. A clamp assembly is mounted on one of the flanges, this assembly is slidable so that a shelf may be clamped to the top of the other flange. A glass shelf extends between a pair of these brackets.

Another shelf bracket assembly is illustrated in U.S. Pat. No. 3,432,134. This shelf bracket assembly provides a shoulder against which a support member abuts. Slots in the wall of the bracket will accommodate the heads of nails or screws, which support the bracket to the wall. The support member is fastened to the metal bracket via screws. The shelf is then set into place on the brackets.

The above patents show older types of shelf and bracket assemblies previously in usage. However, none of the above mentioned patents disclose a glass shelf which is supported by a glass bracket and is capable of holding one hundred pounds of weight; nor do they enable an easy do-it-yourself installation; and there has been a long time need for an easy to install all glass shelf and bracket assembly; which is economical to produce, highly attractive and functional, and which solves the deficiencies in the prior assemblies.

SUMMARY OF THE INVENTION

It is, therefore, an object of the present invention to provide a new and improved glass shelf and bracket assembly.

It is another object of the present invention to provide a shelf and bracket assembly where the brackets' support member is made of glass.

It is yet another object of the present invention to provide an easy to install and use glass shelf and bracket assembly.

To achieve the foregoing objects, the present invention is a glass shelf and bracket assembly. The shelf and bracket assembly includes a rectangular or other shaped shelf, in our example a glass shelf is used but other types may also be used. A glass support member which sits inside of a rubber insert. The rubber insert is then placed within a metal casing. The metal casing is then secured vertically to a wall or other surface, via a screw and collar assembly for example. This screw and collar assembly is inserted in a key slot type orifice in the metal casing which securely locks the bracket in place. Finally, the glass shelf is laid across the first and second bracket.

One advantage of the shelf and bracket assembly is the ease of installation. Another advantage is that the securing screw and collar assembly is first fastened to the wall or other surface and then the shelf bracket is placed upon the screw. Another advantage of the present invention is that it uses glass as the main supporting member for the glass shelf. Another advantage is that the shelf and bracket assembly can hold up to one hundred pounds of weight.

Other objects, features, and advantages of the present invention will be readily appreciated as the same becomes better understood after reading the following description taken in conjunction with the accompanying drawings.

DESCRIPTION OF THE PREFERRED EMBODIMENT(S)

Figure 1:
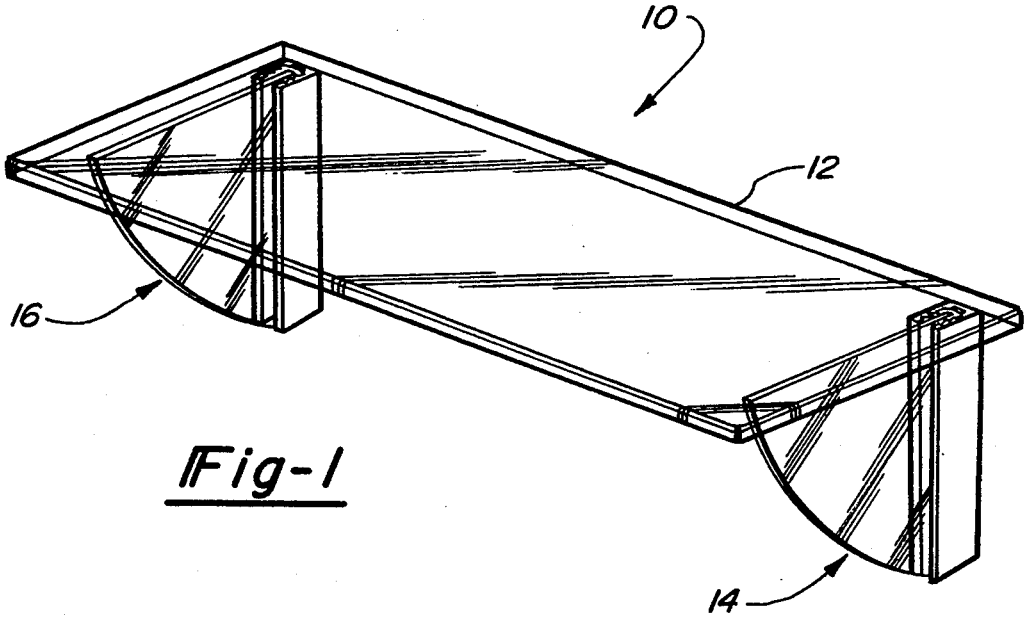
FIG. 1 is a full frontal view of the shelf and bracket assembly.

Referring now to the drawings and the illustrative embodiments depicted therein, FIG. 1 illustrates the completed shelf and bracket assembly 10. The shelf and bracket assembly 10 includes a glass shelf 12, it should be noted that the shelf may be made of another material such as wood, plastic, etc. but in our description a glass shelf will be used, a first bracket 14 and a second bracket 16. The brackets 14 and 16 may also include self adhesive end caps and plastic tabs on the top and bottom edges of the brackets (not shown).

Brackets 14 and 16 are preferably comprised of one quarter of a circle or a quadrant section of glass 20 although other shapes of glass may be used, a rubber insert 22, an outer metal casing member 24, a key lock type orifice 26 extending through the base of the metal casing member 24, and a securing member 28 which will fasten to a wall, in this example the securing member is a screw and collar assembly (28, 30).

The quadrant section of glass 20 is inserted into a hollow rectangular rubber insert 22 which is open on one side. The inside walls of the rubber insert 22 has an inner descending edge 38 which securely fastens to the quadrant section of glass 20. The rubber insert 22 also has an outer extending edge 40 on its outer walls which is placed inside of the metal casing 24. The metal casing 24 also has a rectangular shape that is hollow and open along one side. The inside surface of the metal casing 24 has an inner descending edge 36 design which corresponds to the outer shape of the rubber insert 22. The metal casing 24 also contains a key lock orifice 26 in its base wall. The securing means 28, in this example a screw, is fastened to a wall until the collar 30 comes into contact with the wall. The metal casing 24 is then placed onto the screw 28 via the key lock orifice 26. This securely fastens each bracket (14, 16) to the wall and then the glass shelf 12 is placed upon the brackets (14, 16).

Figure 2:
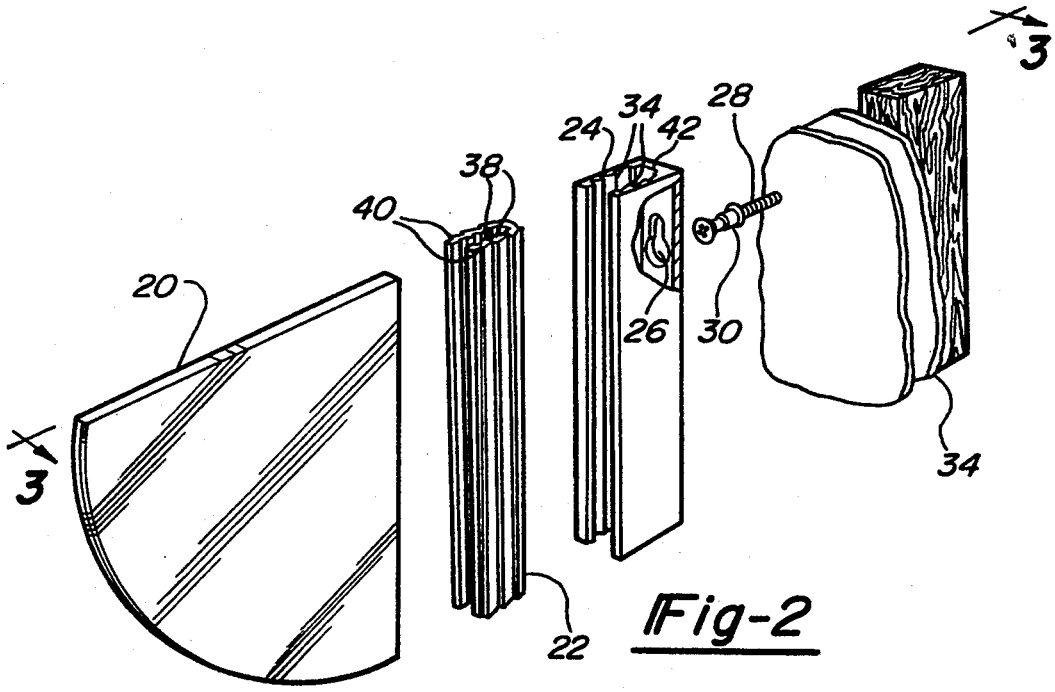
FIG. 2 is an exploded view of one of the bracket assemblies.
Figure 4:
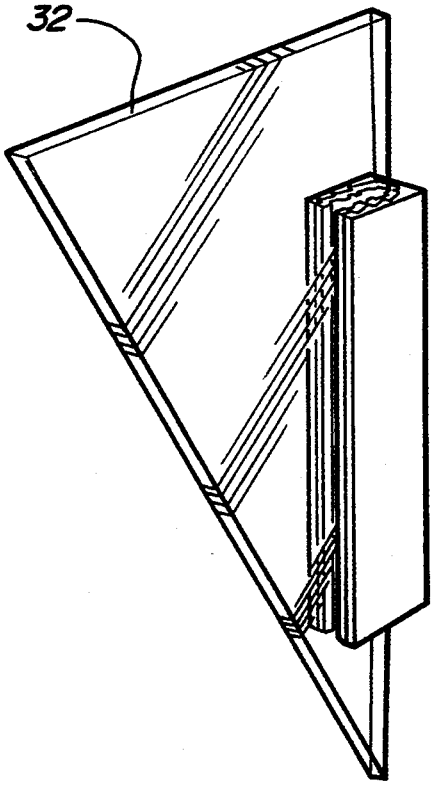
FIG. 4 is a triangular variation of the glass supporting member.
Figure 5:
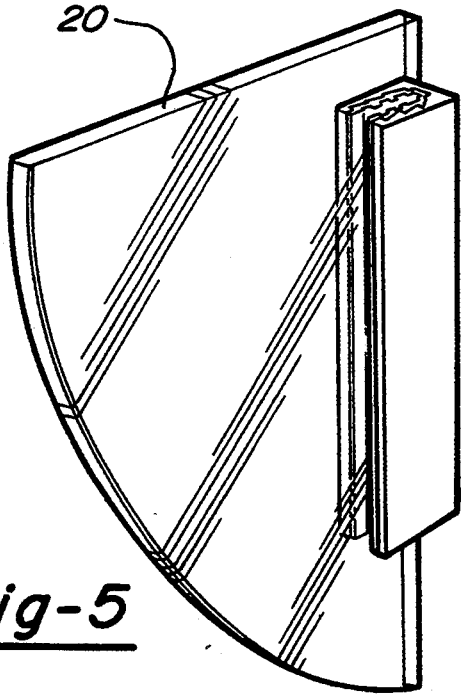
FIG. 5 is a one-quarter of a circle or quadrant variation of the glass supporting member.

The glass support member 20 is preferably in the shape of a quarter of a circle or a quadrant, see FIGS. 2 and 5, this will give the most support possible, yet have the sleek lines of a circle. Other shapes can be used for the glass support member, for example a triangular shape 32, see FIG. 4.

The rubber insert 22 which the glass support member 20 is placed in is preferably a 40 or 60 Shore A durometer, ethylene propylenediene monomer/rubber or EPDM/rubber. The rubber insert 22 generally has a U-shape that includes a base and a pair of walls extending from the base to form a cavity. This cavity is approximately the thickness of the glass support member 20. The inside walls of the rubber insert 22 have an inner descending edge 38, or in our example three inner descending edges 38. The glass support member 20 has a rubber epoxy applied to its surfaces which will be placed within the cavity of the rubber insert 22. This rubber epoxy will react with the glass and form grooves which will interconnect with the inner descending edges 38 of the rubber insert 22. Thus the glass support member 20 will be securely locked in place.

Conversely, the outer walls of the rubber insert 22 have outer extending edges 40, or in our example three outer extending edges 40. These will be used to interconnect and lock with the metal casing 24. The rubber insert 22 also serves to protect the edges and surfaces of the glass support member 20 from becoming damaged or marred due to interaction with a hard metal. Any type of damage to the glass support member 20 would also weaken its structural integrity, thus reducing the capacity of the entire shelf assembly 10.

Figure 3:
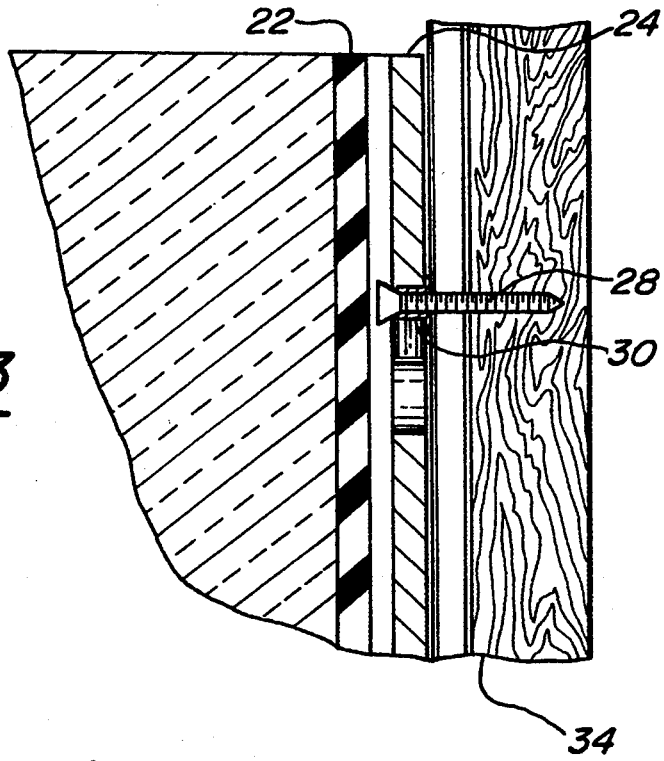
FIG. 3 is a cut away view of one of the brackets as it appears securely fastened to a wall.

The metal casing 24 mentioned above is in our example made of aluminum, however other types of metals may be used. The metal casing 24 generally has a U-shape which includes a base and a pair of walls extending from the base to form a cavity. The cavity is approximately the thickness of the rubber insert 22 with the glass support member 20 inserted. The inner walls of the metal casing 24 have an inner descending edge 36, or in our example three inner descending edges 36. These edges will be used to interconnect and lock the rubber insert 22 into the metal casing 24. The inner base wall of the metal casing 24 also has a recess 42 which allows for the securing device 28 or screw head in our case, to be inserted into the outer base wall of the metal casing 24 without coming in contact with the base of the rubber insert 22. A key lock orifice 26 is also located in the base of the metal casing 24. The key lock orifice 26 allows for the screw head 28 to be easily inserted and then locked in place after the screw and collar (28, 30) have been fastened to the wall 34 or other suitable surface, see FIG. 3.

The rubber insert 22 with the glass support member 20 is pressure fitted into the metal casing 24. Once inside the metal casing 24, the outer extending edges 40 of the rubber insert 22 will interconnect with the inner descending edges 36 of the metal casing 24 and be locked into place. The interconnecting edges and the pressure fit assure that the glass support member 20 will not slip or slide within the metal casing 24. The length of the glass support member 20 will determine the depth of shelf which can safely be placed upon the brackets 14 and 16.

In actual use, two of the bracket assemblies 14, 16 are mounted vertically on a wall 34 at the same height. An end cap is placed on the top and bottom of each of the brackets. The end caps in our example are self-adhesive. A series of plastic tabs may also be placed upon the top edge of the glass support member 20, this will prevent the glass shelf 12 from shifting when placed on top of the two glass support members 20.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A shelf and bracket assembly comprising:

a rectangular shelf;

a first bracket including a quadrant glass support member vertically disposed in a rubber insert, said quadrant glass support member having a rubber epoxy applied to the section being disposed in said rubber insert, said rubber insert being pressure fitted into a metal casing, said metal casing having a key lock orifice to support said first bracket on a securing screw and collar assembly, said quadrant glass support member being vertically flush with said metal casing and said rubber insert, said rubber insert generally having a U-shape including a base and a pair of walls extending from said base to form a cavity approximately the thickness of said quadrant glass member, said rubber insert having three inner descending edges on each of said inner walls and three outer extending edges on each of the outer walls, said metal casing generally having a U-shape including a base and a pair of walls extending from said base to form a cavity approximately the thickness of said rubber insert with said quadrant glass member inserted, said metal casing having three inner descending edges on each inner wall and a recess area on the inside of said base which receives the head of said securing screw via the said key lock orifice and;

a second bracket including a quadrant glass support member disposed in a rubber insert, said quadrant glass support member having a rubber epoxy applied to the section being disposed in said rubber insert, said rubber insert being pressure fitted into a metal casing, said metal casing having an orifice to support said second bracket on a securing member, said quadrant glass support member being vertically flush with said metal casing and said rubber insert, said rubber insert generally having a U-shape including a base and a pair of walls extending from said base to form a cavity approximately the thickness of said quadrant glass member, said rubber insert having three inner descending edge on each inner wall and three outer extending edges on each outer wall, said metal casing generally having a U-shape including a base and a pair of walls extending from said base to form a cavity approximately the thickness of said rubber insert with said quadrant glass member inserted, said metal casing having three inner descending edges on each inner wall and a recess area on the inside of said base which receives the head of said securing screw via the said key lock orifice.

* * * * *